US007312413B2

(12) United States Patent
Liang

(10) Patent No.: US 7,312,413 B2
(45) Date of Patent: Dec. 25, 2007

(54) ELECTRONIC DEVICE AND KEY ASSEMBLY THEREOF

(75) Inventor: Jen-Yu Liang, Tu-Cheng (TW)

(73) Assignee: Hon Hai Precision Industry Co., Ltd., Tu-Cheng (TW)

( * ) Notice: Subject to any disclaimer, the term of this patent is extended or adjusted under 35 U.S.C. 154(b) by 0 days.

(21) Appl. No.: 11/308,579

(22) Filed: Apr. 8, 2006

(65) Prior Publication Data

US 2007/0023268 A1 Feb. 1, 2007

(30) Foreign Application Priority Data

Jul. 29, 2005 (CN) ..... 2005 1 0036291

(51) Int. Cl.
*H01H 9/00* (2006.01)

(52) U.S. Cl. ..... 200/314; 200/317; 341/20

(58) Field of Classification Search ..... 200/310, 200/313, 314, 317, 341–345, 5 A, 520; 341/20, 341/34

See application file for complete search history.

(56) References Cited

U.S. PATENT DOCUMENTS

| | | | | |
|---|---|---|---|---|
| 5,350,889 | A * | 9/1994 | Lauritsen | 200/315 |
| 5,560,475 | A * | 10/1996 | Brundage et al. | 200/315 |
| 5,660,270 | A * | 8/1997 | Martin et al. | 200/315 |
| 6,013,884 | A * | 1/2000 | Rudolph et al. | 200/339 |
| 6,824,288 | B2 | 11/2004 | Prindle | |
| 6,876,313 | B2 * | 4/2005 | Hsiung et al. | 200/310 |
| 6,907,328 | B2 * | 6/2005 | Fehr et al. | 200/339 |

* cited by examiner

*Primary Examiner*—Elvin Enad
*Assistant Examiner*—M. Fishman
(74) *Attorney, Agent, or Firm*—Wei Te Chung

(57) ABSTRACT

A key assembly (B) mounted on a circuit board (200) includes a frame (23), a keytop (24), a switch (21), and a light emitting component (22). The frame includes a protrusion (230) formed a front thereof. The keytop defines a slot (241) shaped to correspond to a shape of the protrusion. The protrusion is received in the slot without protruding from a surface of the keytop. The switch is for electrically connection to the circuit board. The light emitting component is disposed inside the frame and for electrically connection to the circuit board. An electronic device (A) utilizing the key assembly is also provided.

20 Claims, 5 Drawing Sheets

ELECTRONIC DEVICE AND KEY ASSEMBLY THEREOF

FIELD OF THE INVENTION

The present invention relates to electronic devices, and particularly to an electronic device with a key assembly.

DESCRIPTION OF RELATED ART

Nowadays, operation buttons in the form of an array of keys are used in all kinds of electronic devices, and are disposed on operation panels of many kinds of electronic devices. The keys of electronic devices such as personal computers (PCs), portable computers and mobile telephones are often provided as part of a key assembly. The key assembly includes a backlighting component, which allows the keys to be conveniently manipulated even under poor lighting conditions or in darkness.

FIG. 5 shows a conventional key assembly. The key assembly 10 is mounted on a circuit board 100. An operation panel (not shown) of an associated electronic device is oriented parallel with the circuit board 100. The key assembly 10 comprises a switch 11, a body 13, and a keytop 14. The switch 11, the body 13 and the keytop 14 are integrated, and generally located one above the other, with the switch 11 being vertically mounted on the circuit board 100. The keytop 14 has a desired character 140 printed thereon. A light emitting component (not visible) is disposed on a surface of the circuit board 100 below the keytop 14. The light emitting component is typically a light emitting diode (LED). When the light emitting component is lit up, light emitted by the light emitting component illuminates the keytop 14. Thus, the character 140 is clearly visible under poor lighting conditions or in darkness.

The key assembly 10 is integrated with the switch 11, the body 13 and the keytop 14. Therefore, in general, the operation panel of the electronic device must also be oriented parallel to the circuit board 100. In other words, due to its structural limitations, the key assembly 10 can generally only be provided parallel to the circuit board 100. However, in some electronic devices, the operation panel is required to be oriented perpendicular to or in some other position relative to the circuit board 100 for reasons of functionality or better aesthetic appearance. In such cases, the key assembly 10 may not be easily visible and may be difficult to manipulate.

SUMMARY OF INVENTION

An exemplary embodiment of the present invention provides a key assembly for mounting on a circuit board. The key assembly includes a frame, a keytop, a switch, and a light emitting component. The frame includes a protrusion formed a front thereof. The keytop defines a slot shaped to correspond to a shape of the protrusion. The protrusion is received in the slot without protruding from a surface of the keytop. The switch is for electrically connection to the circuit board. The light emitting component is disposed inside the frame and for electrically connection to the circuit board.

Another exemplary embodiment of the present invention provides an electronic device. The electronic device includes a cover, a circuit board, and a key assembly. The circuit board and the key assembly are disposed in the cover. The key assembly includes a frame, a keytop, a switch, and a light emitting component. The frame includes a protrusion formed a front thereof. The keytop defines a slot shaped to correspond to a shape of the protrusion. The protrusion is received in the slot without protruding from a surface of the keytop. The switch is for electrically connection to the circuit board. The light emitting component is disposed inside the frame and for electrically connection to the circuit board.

Other advantages and novel features will be drawn from the following detailed description of preferred embodiments with the attached drawings, in which:

DETAILED DESCRIPTION

Figure 1:
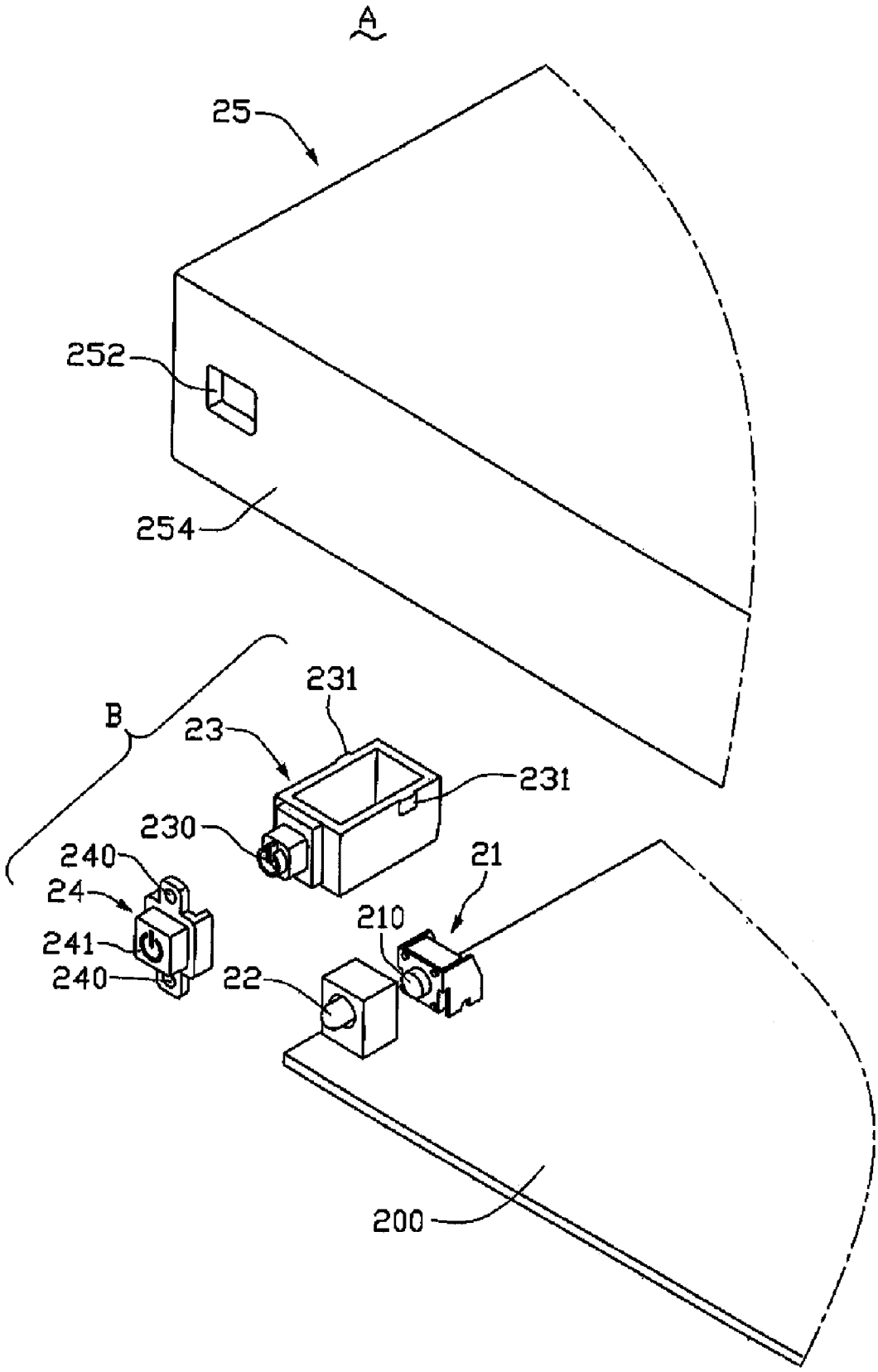
FIG. 1 is an exploded, isometric view of part of an electronic device of an exemplary embodiment of the present invention, the electronic device comprising a cover, a circuit board and a key assembly, the key assembly comprising a frame.

FIG. 1 is an exploded, isometric view of part of an electronic device A of an exemplary embodiment of the present invention. The electronic device A comprises a cover 25, a circuit board 200, and a key assembly B. The key assembly B and the circuit board 200 are disposed inside the cover 25. The key assembly B comprises a switch 21, a light emitting component 22, a frame 23, and a keytop 24. In the exemplary embodiment, the light emitting component 22 is a light emitting diode (LED).

The lighting emitting component 22 is disposed inside the frame 23, and is mechanically fixed to and electrically connected with circuitry on the circuit board 200. The switch 21 is disposed outside the frame 23, and is also mechanically fixed to and electrically connected with circuitry on the circuit board 200. Thus, the light emitting component 22 and the switch 21 are electrically connected with each other via circuitry on the circuit board 200. In the exemplary embodiment, the switch 21 comprises a contact button 210.

In the exemplary embodiment, the frame 23 is hollow, and is made of a transparent plastic material. Two protuberances 231 are provided on opposite lateral sides of the frame 23 respectively. The frame 23 is stepped at a front portion thereof, and a protrusion 230 is formed in relief on the front portion. The protrusion 230 is a distinguishable character or symbol that indicates a function of the key assembly B. In the illustrated embodiment, the protrusion 230 is a two-part component that overall represents a power symbol. The keytop 24 can be made of a transparent or non-transparent plastic material. The keytop 24 defines a slot 241 shaped to correspond to a shape of the protrusion 230. In the illustrated embodiment, the slot 241 is a two-part void that overall also represents the power symbol. The protrusion 230 can be received in the slot 241 without protruding from a front surface of the keytop 24. The keytop 24 also defines two opposite top and bottom guide holes 240.

Figure 2:
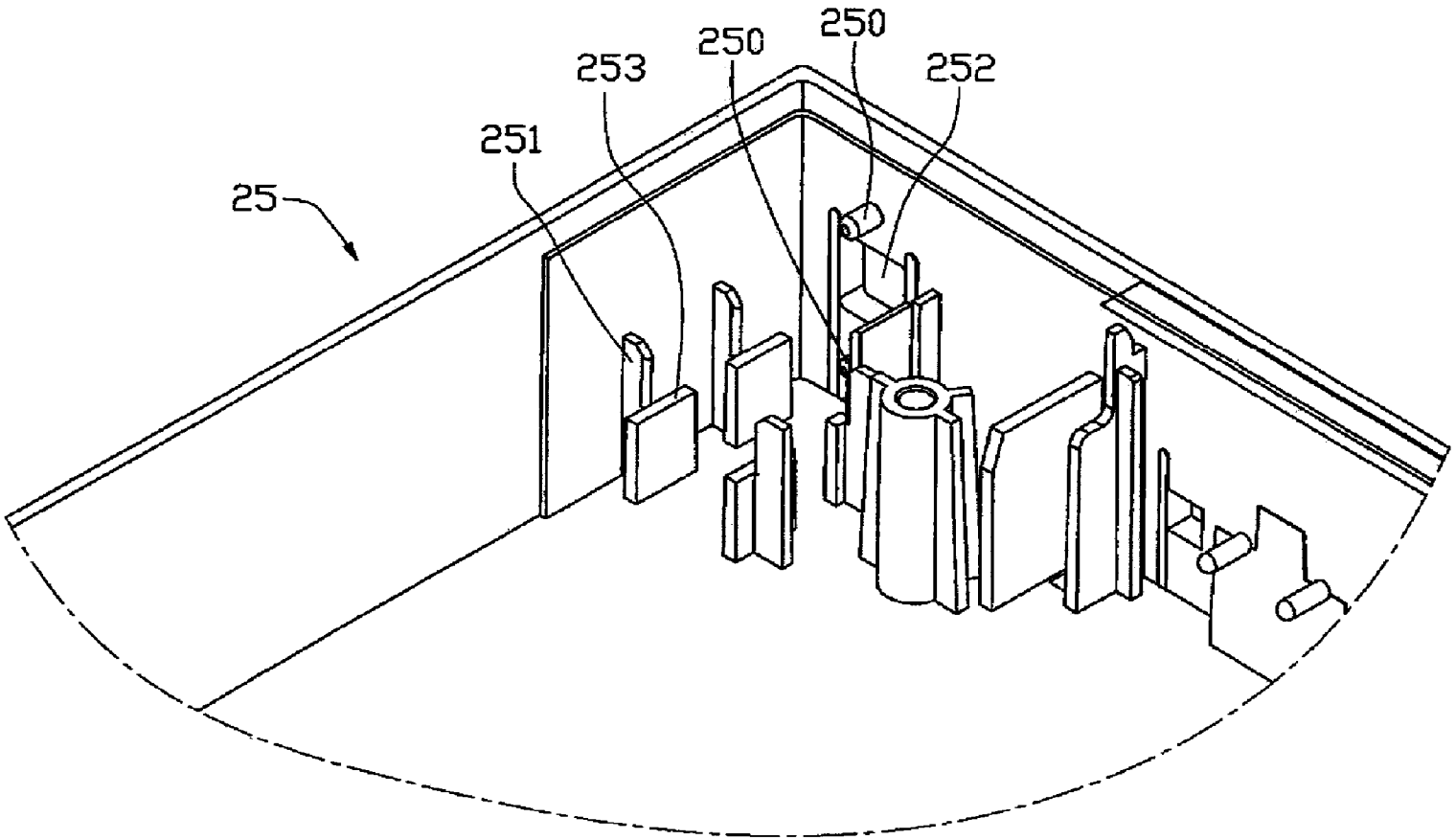
FIG. 2 is an inverted view of the cover of the electronic device shown in FIG. 1.
Figure 3:
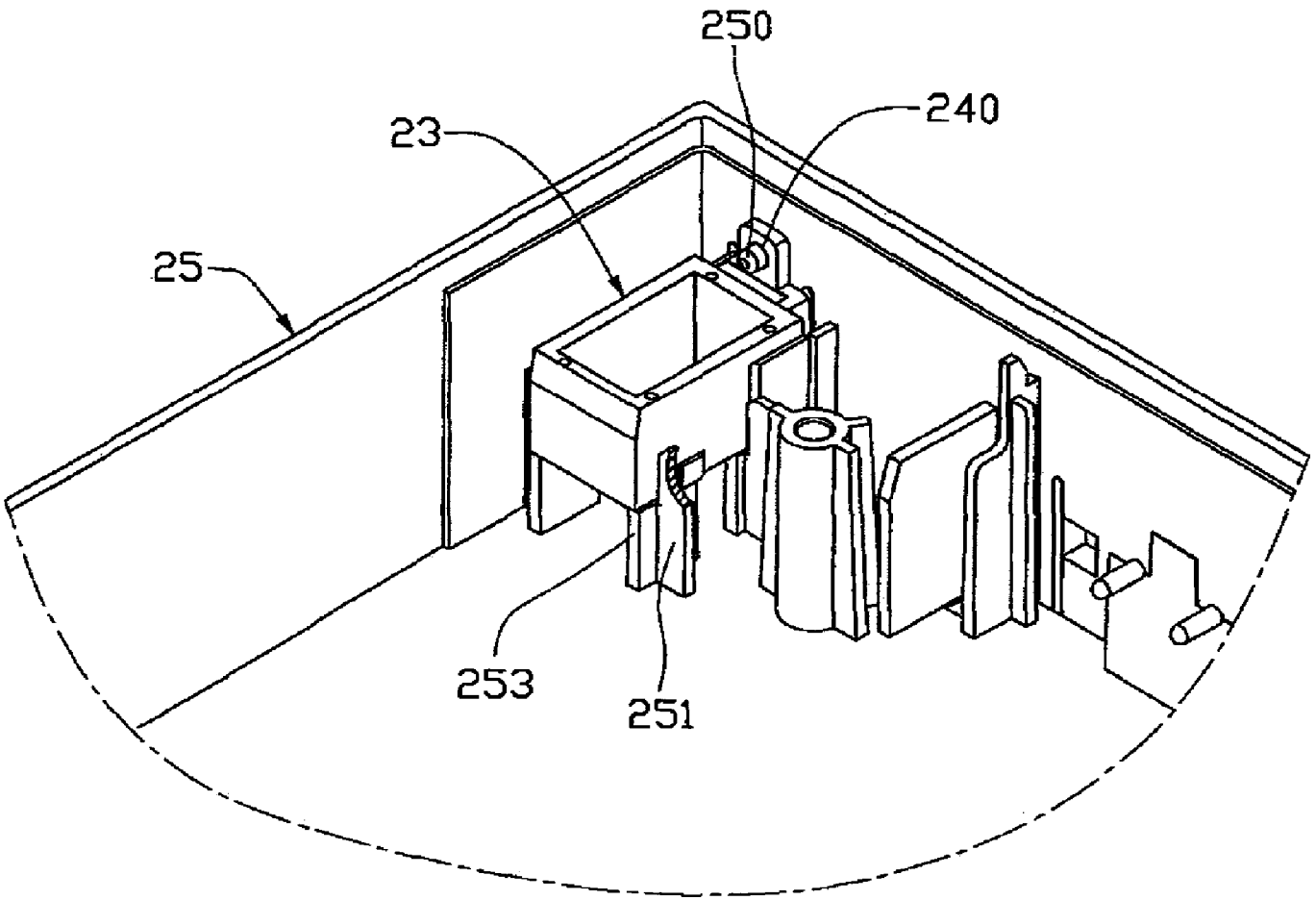
FIG. 3 is similar to FIG. 2, but showing the frame attached to the cover.

In pre-assembly, the frame 23 and the keytop 24 are combined together. Then the combined frame 23 and keytop 24 is attached to the cover 25. The cover 25 comprises an operation panel 254, and the operation panel 254 defines a hole 252. In the exemplary embodiment, the operation panel 254 is oriented perpendicular to the circuit board 200. Referring also to FIGS. 2 and 3, the cover 25 also comprises two guide members 250, two pairs of stop blocks 251, and a plurality of positioning blocks 253. In the exemplary embodiment, the guide members 250 are in the form of guide pins, and are oriented parallel to the circuit board 200. The frame 23 is moved in a horizontal direction toward an inside of the operation panel 254, with the guide holes 240 movably receiving the guide members 250. The frame 23 is thus movably attached to the cover 25. In the exemplary embodiment, one of the protuberances 231 of the frame 23 is disposed between one of the pairs of stop blocks 251, and the other protuberance 231 of the frame 23 is disposed between the other pair of stop blocks 251. The protuberances 231 and two of the stop blocks 251 that are distalmost from the operation panel 254 cooperate to prevent the frame 23 from being displaced too far horizontally into the cover 25. The positioning blocks 253 abut a top of the frame 23, to prevent the frame 23 from being displaced upwardly. In addition, the stop blocks 251 and the protuberances 231 of the frame 25 are spaced a predetermined distance apart such that the frame 23 can move horizontally inward when the key assembly B is pressed by a user.

Figure 4:
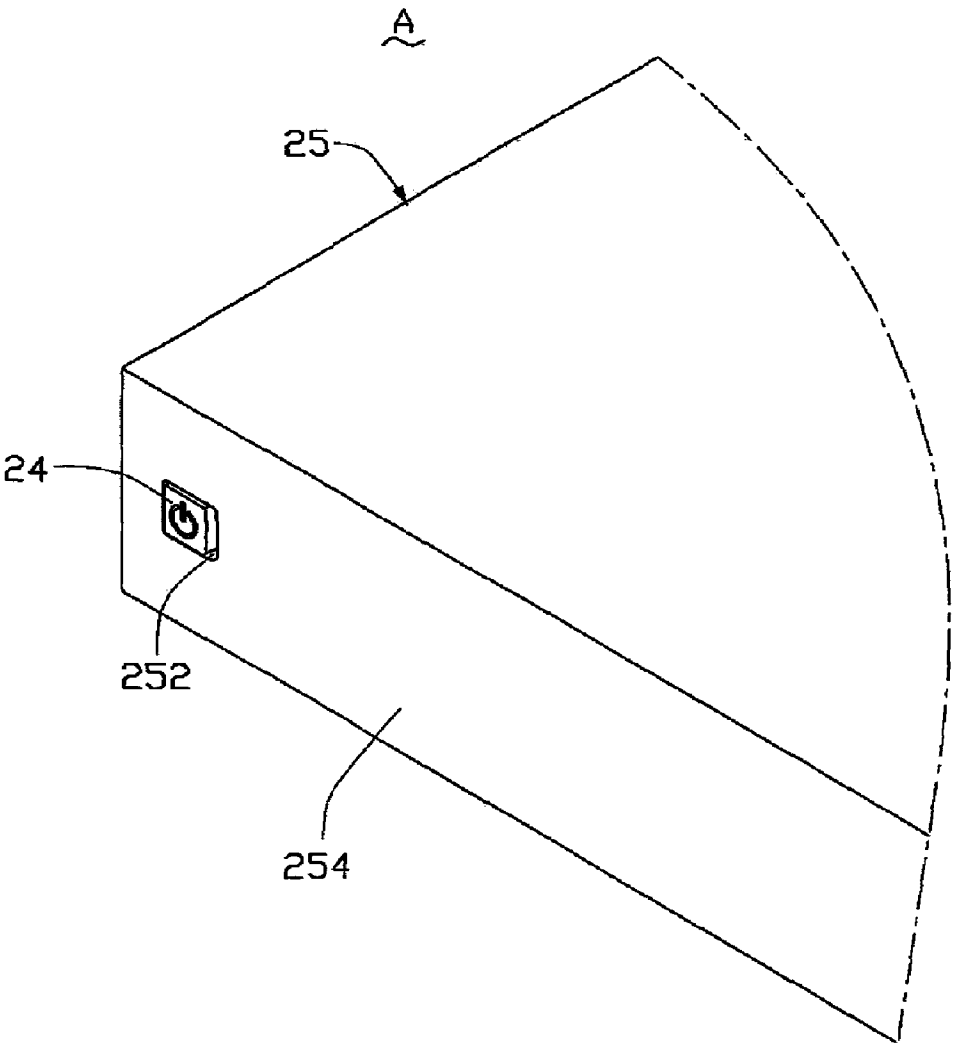
FIG. 4 is an assembled view of the electronic device shown in FIG. 1.
Figure 5:
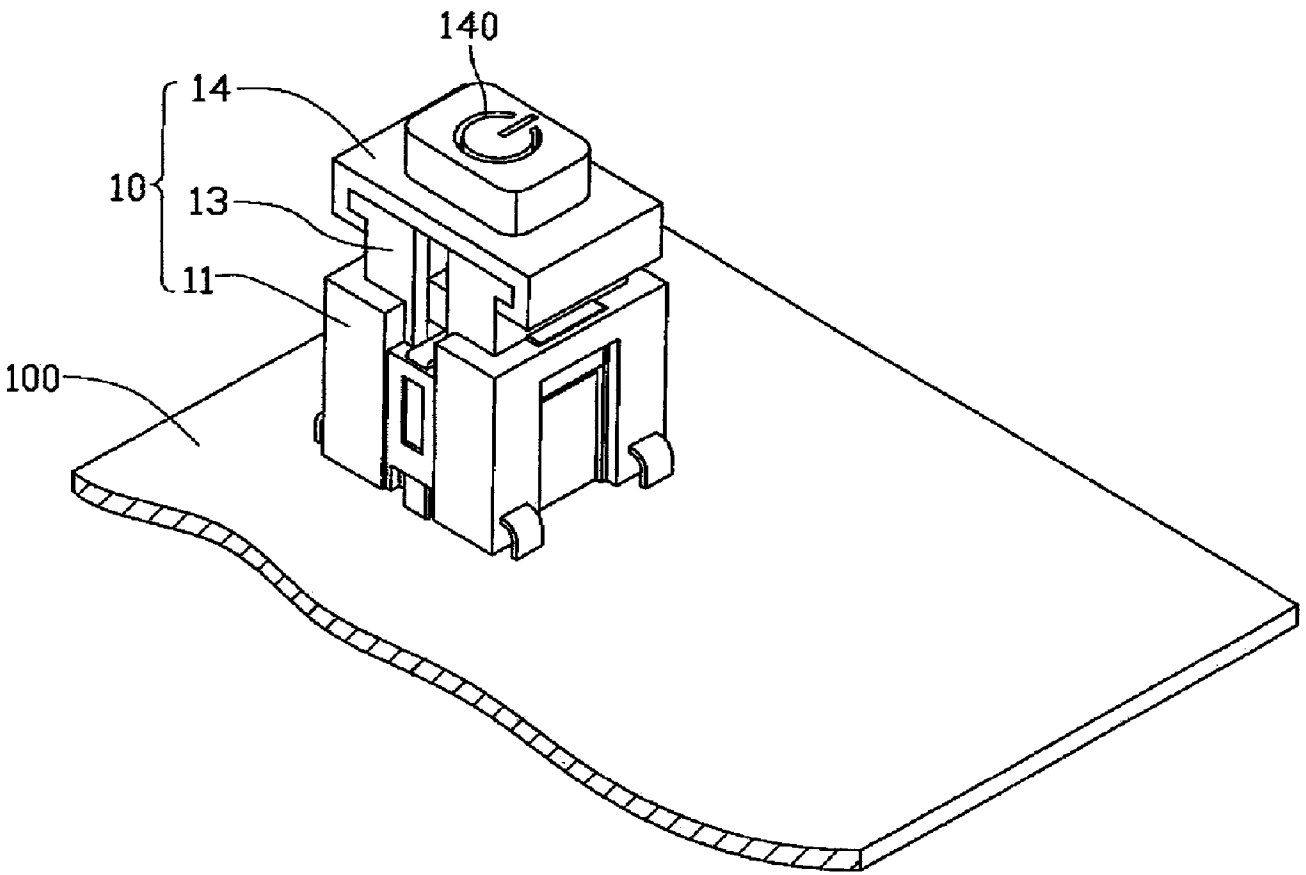
FIG. 5 (RELATED ART)
FIG. 5 is an isometric view of part of an electronic device that comprises a conventional key assembly.

In assembly, the cover 25 with the frame 23 and keytop 24 attached thereto is attached onto the circuit board 200. Referring also to FIG. 4, the keytop 24 of the key assembly B is received in the hole 252 of the cover 25, and protrudes slightly from the operation panel 254 of the cover 25. When the key assembly B is pressed, the keytop 24 no longer protrudes from the operation panel 254.

In operation, when the keytop 24 is pressed, the frame 23 is slid horizontally inward in a direction parallel to the circuit board 200, and an inner end of the frame 23 mechanically contacts the contact button 210 of the switch 21. Thus the contact button 210 is pressed, and the switch 21 activates circuitry connecting the light emitting component 22 with the switch 21. Accordingly, the light emitting component 22 is lit up. Light emitted by the light emitting component 22 illuminates the protrusion 230 so that the character or symbol represented by the protrusion 230 is clearly distinguishable.

In further embodiments, the light emitting component 22 can emit different colored light in order to indicate whether the electronic device A is switched on or off. For example, when the light emitting component 22 emits green light, the character or symbol appears green, which indicates that the electronic device A is switched on. When the light emitting component 22 emits orange light, the character or symbol appears orange, which indicates that the electronic device A is switched off. In this way, the on/off status of the electronic device A is clearly represented by different colors of the key assembly B. In other embodiments, a spring or elastic element can be employed to facilitate convenient pressing of the keytop 24 and operation of the key assembly B.

Since the switch 21, the light emitting component 22 and the frame 23 of the key assembly B are aligned so that the frame 23 is movable in directions parallel to the circuit board 200, the key assembly B can be disposed at the operation panel 254, with the operation panel 254 being perpendicular to the circuit board 200.

While particular embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A key assembly for mounting on a circuit board, comprising:

a frame comprising at least one protrusion formed on a front thereof;

a keytop defining at least one slot shaped to correspond to a shape of the protrusion, wherein the protrusion is received in the slot without protruding from a surface of the keytop;

a switch for electrically connecting to the circuit board; and a light emitting component disposed inside the frame and being for electrically connecting to the circuit board;

wherein when the switch and the light emitting component are mounted to the circuit board and the keytop is pressed, the frame is driven in a direction not perpendicular to the circuit board to contact the switch.

2. The key assembly as claimed in claim 1, wherein the protrusion is shaped to represent a desired character or symbol.

3. The key assembly as claimed in claim 1, wherein the frame is hollow.

4. The key assembly as claimed in claim 1, wherein the frame comprises transparent plastic material.

5. The key assembly as claimed in claim 1, wherein the keytop comprises non-transparent and/or transparent plastic material.

6. The key assembly as claimed in claim 1, wherein the switch comprises a contact button, for activating the light emitting component via circuitry on the circuit board.

7. An electronic device comprising:

a cover;

a circuit board disposed in the cover; and a key assembly disposed in the cover, the key assembly comprising:

a frame comprising at least one protrusion formed on a front thereof;

a keytop defining at least one slot shaped to correspond to a shape of the protrusion, wherein the protrusion is received in the slot without protruding from a surface of the keytop;

a switch electrically connected to the circuit board; and a light emitting component disposed inside the frame and electrically connected to the circuit board;

wherein when the keytop is pressed, the frame is driven in a direction not perpendicular to the circuit board to contact the switch, whereby the light emitting component is activated to illuminate the protrusion of the frame.

8. The electronic device as claimed in claim 7, wherein the frame is movably attached to the cover.

9. The electronic device as claimed in claim 7, wherein the frame further comprises at least one protuberance, the cover comprises at least one stop block, and the protuberance is blocked by the stop block in order to prevent the frame from being displaced too far when the keytop is pressed.

10. The electronic device as claimed in claim 9, wherein when the frame is in a starting position, the stop block and the protuberance are spaced apart a predetermined distance.

11. The electronic device as claimed in claim 7, wherein the keytop further defines a plurality of guide holes, the cover comprises a plurality of guide members oriented parallel to the circuit board, and the guide holes movably receive the guide members to guide the frame to move in a direction parallel to the circuit board.

12. The electronic device as claimed in claim 7, wherein the protrusion is shaped to represent a desired character or symbol.

13. The electronic device as claimed in claim 7, wherein the frame comprises transparent plastic material.

14. The key assembly as claimed in claim 7, wherein the keytop comprises non-transparent or transparent plastic material.

15. The electronic device as claimed in claim 7, wherein the switch comprises a contact button, for activating the light emitting component via circuitry on the circuit board.

16. The electronic device as claimed in claim 7, wherein the cover comprises at least one positioning block, for abutting a top of the frame to prevent the frame from being displaced upwardly.

17. An electronic device comprising:

an operation panel of said electronic device defined along a side of said electronic device;

a switch installable in said electronic device spaced from said operation panel, and capable of providing a preset function for said electronic device;

a light emitting component installable in said electronic device between said operation panel and said switch, and capable of illuminating said operation panel by light therefrom; and a keytop movably installable around said operation panel in said electronic device and exposable to an outside of said electronic device through said operation panel so as to introduce said light from said light emitting component to said outside via said keytop directly, a frame extending from said keytop toward said switch, and movable together with said keytop between a first position thereof where said frame engages with said switch to trigger said preset function of said switch and a second position thereof where said frame disengages from said switch to disable said preset function, said frame capable of moving around and relative to said light emitting component without performing any influence thereon.

18. The electronic device as claimed in claim 17, wherein said light emitting component is installable inside said frame regardless of moving of said frame between said first and second positions thereof.

19. The electronic device as claimed in claim 17, wherein said switch and said light emitting component are installable in said electronic device next to each other along a predetennined plane, and said frame is movable relative to said light emitting component in a direction not perpendicular to said predetermined plane.

20. The electronic device as claimed in claim 17, wherein said frame is discretely formed from said keytop, said frame comprises at least one protrusion formed on a front thereof and said keytop defines at least one slot shaped to correspond to a shape of said at least one protrusion of said frame.

* * * * *